US005769534A

United States Patent [19]

Lewis

[11] Patent Number: 5,769,534

[45] Date of Patent: Jun. 23, 1998

[54] ILLUMINATED DISPLAY SIGN APPARATUS

[76] Inventor: Richard G. Lewis, 1601 S. Moorland Rd. Ste. 207, New Berlin, Wis. 53151

[21] Appl. No.: 822,114

[22] Filed: Mar. 21, 1997

[51] Int. Cl.[6] ..... F21L 7/00; G09F 13/04

[52] U.S. Cl. ..... 362/367; 362/260; 362/311; 362/374; 40/574

[58] Field of Search ..... 362/223, 260, 362/311, 374, 351, 812, 455; 40/574, 575

[56] References Cited

U.S. PATENT DOCUMENTS

| | | | |
|---|---|---|---|
| 2,726,757 | 12/1955 | Kellstrom . | |
| 3,593,447 | 7/1971 | Winegarten | 40/130 R |
| 5,282,331 | 2/1994 | Fell | 40/167 |
| 5,355,603 | 10/1994 | Lulkkonrn | 40/541 |
| 5,373,428 | 12/1994 | Day | 362/223 |
| 5,448,845 | 9/1995 | Gibson | 40/611 |
| 5,584,547 | 12/1996 | Trulaske, Sr. | 312/223.5 |

*Primary Examiner*—James C. Yeung

*Assistant Examiner*—Nhat-Hang H. Lam

*Attorney, Agent, or Firm*—Andrus, Sceales, Starke & Sawall

[57] ABSTRACT

An illuminated display box includes one or more display sides. Each side includes identical panel support units connected to angled sidewalls of a bracket on the opposite sides of the display. Each support unit is an integrally extruded U-shaped plastic member, and includes an attachment leg and a panel support leg connected by a U-shaped base. The attachment leg has an edge slot extended over the angled sidewall and fixedly secured by a lanced portion of the angled sidewall. The support leg has an open slot to receive a dual panel unit including superimposed transparent panels between which a display poster is held. The panel units are formed of a flexible and optically clear plastic and have a width in excess of the distance between the slots of the two side panel support units. Insertion of the panel edges into the slots creates a curved panel unit. The display box may have a single display panel unit or a plurality of display panel units arranged to form a plurality of sides of the display box.

14 Claims, 5 Drawing Sheets

FIG. 1
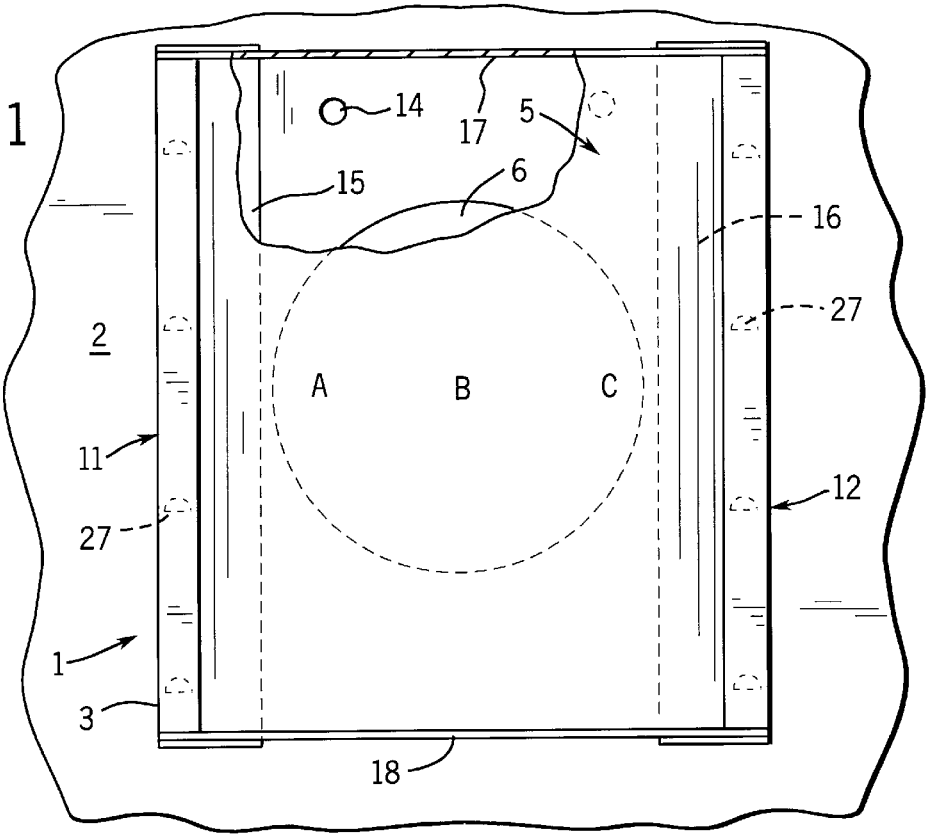
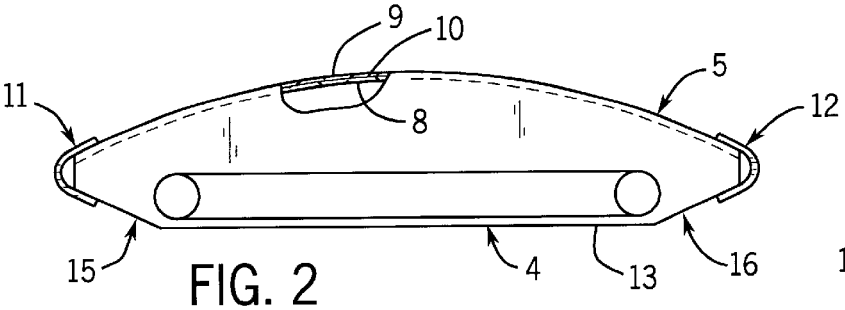
FIG. 2
FIG. 3
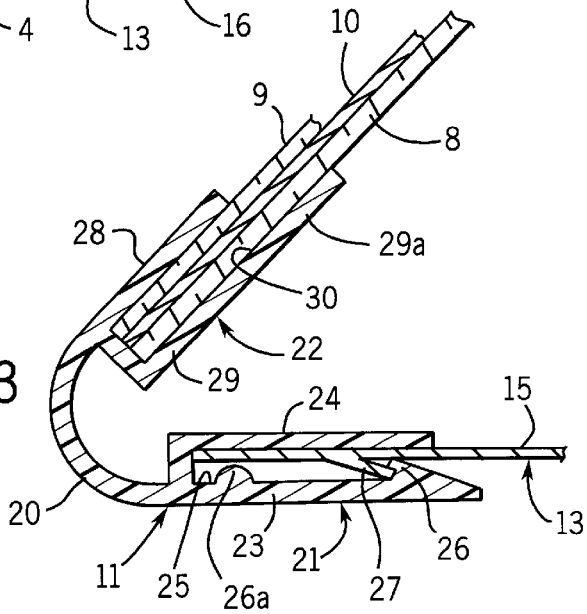

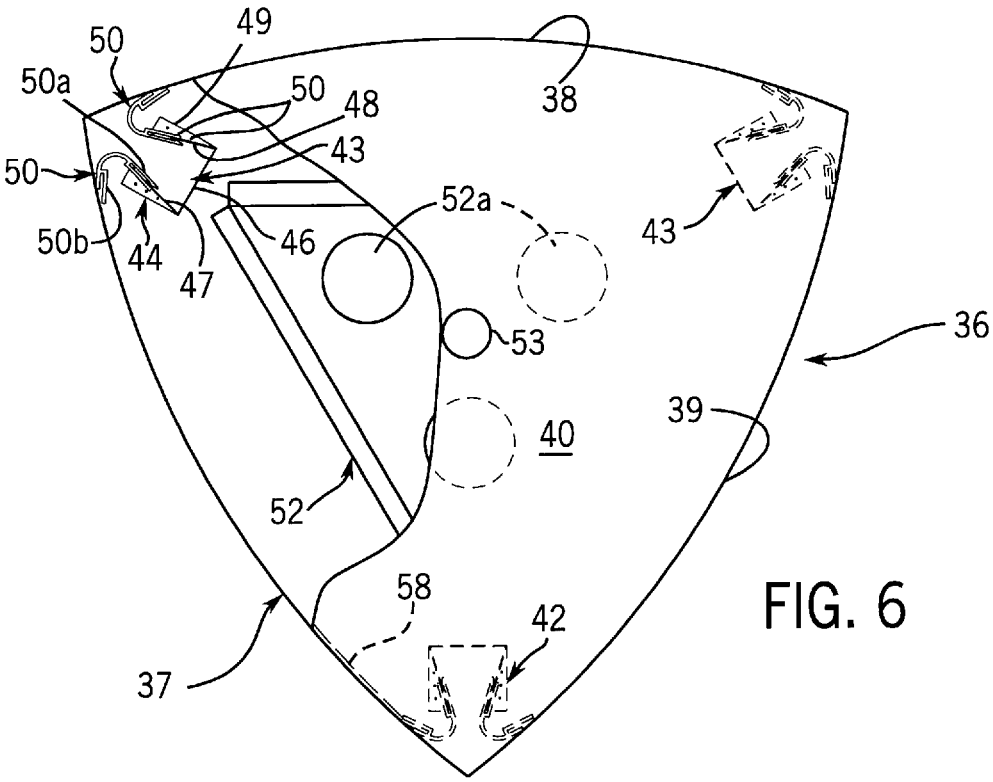
FIG. 6
FIG. 7
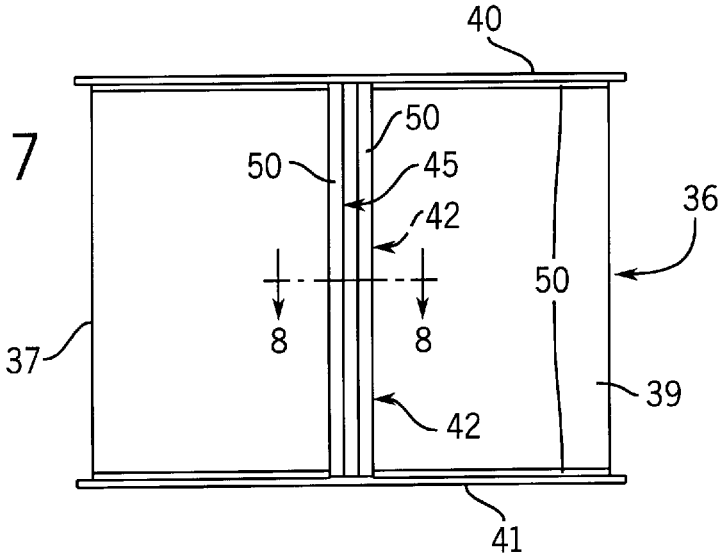

ILLUMINATED DISPLAY SIGN APPARATUS

BACKGROUND OF THE INVENTION

This invention relates an illuminated display sign apparatus and particularly to such a display sign apparatus incorporating a replaceable display element.

Advertising display apparatus is widely used in promotion and sale of products. Illuminated sign apparatus provide a particularly effective marketing tool. The illuminated display apparatus includes a housing with a front display panel. Suitable illuminating devices such as fluorescent lamps or other like elements are secured to project light through the front display panel and thereby drawing attention to the subject matter carried by the display panel. One such apparatus includes a relatively shallow back support structure to which lamps or the like are secured. Sidewalls project forwardly with a transparent panel closing the front of the sign. A display sheet is interposed or secured to the front side of the panel and is constructed to permit illumination of the display member as a result of the light. A particularly satisfactory display system includes a pair of transparent panels adapted to receive a display poster located therebetween. Light translucent panels are particularly selected to disperse the light across the poster and providing an esthetically pleasing display which is comfortably viewed. The panels are secured to the sidewalls of the back plate structure with a suitable releasable constructions to permit the replacement of the display sheet or poster for periodic updating or changing of the displayed subject matter. U.S. Pat. No. 5,373,428 discloses a dual display panel system with superimposed panels specially formed to mate with angled sidewalls of a back plate. The panels include rearwardly formed angled lips integrally formed with the panel for attachment to the sidewalls. The one lip of both panels is fixed to the one angled sidewall of the back plate to provide a fixed mounting. The opposite leg of the outer panel is secured to the opposite sidewall by a suitable hook mechanism to allow release thereof. The opposite leg of the inner panel terminates at the outer end of the opposite sidewall. Release of the outer panel allows the interpositioning of a transparent display member between the two panels.

Other lightboxes providing an illumination of a front transparent panel assembly are available in the prior art. See, for example, British Patent application 2,105,896 which was published Sep. 14, 1983 and U.S. Pat. No. 5,355,603.

SUMMARY OF THE PRESENT INVENTION

The present invention is directed to an illuminated display box having a front dual panel unit to receive a transparency or other display member to be displayed, with illumination from the back side of the display member. The present invention is more particularly directed to a modular construction of a display box including a spaced panel support unit attached to spaced wall members. The sidewall structure is secured between spaced end wall members to form at least one display opening window. A dual panel display unit is releasably secured to the spaced panel support units for introduction of the display material or elements, in combination with back lights mounted within the display box. Generally, in accordance with the present invention, each of the panel support units is formed having a substantially U-shaped cross section with an attachment or mounting section and a panel support section connected by a curved base portion. Each section is formed with an end edge slot or opening. The mount section is secured to the plate support and the panel support section is formed respectively receiving the sidewall portion of a support plate and locating the dual panel unit defining the front wall. The panel support units and the panel units may be formed of a suitable opaque material but in certain applications are preferably formed of optically clear plastic to present the display box with essentially only the displayed material viewed from the front of the sign and forming a non-supported front wall. If an opaque panel support unit is used, the balance of the outer enclosure may be formed of the same color to again provide a pleasing appearance.

The panel support units provide for a simple releasable mounting of the dual panel unit, and further provide for maximum facility of insertion and removal of the panels and the display material contained therebetween.

In a preferred commercial construction, the box unit includes a back plate having forward angled side edge portions defining the sidewalls of the box. Lighting units are secured to the back plate between the side edge portions. The panel support units are extruded, single integral members including a back plate attachment leg or section and a front panel support leg or section which are joined by a single thickness connecting U-shaped wall. The legs extend outwardly as generally planar extensions of the U-shaped base. The attachment leg includes a slot formed by spaced walls. The mounting attachment leg including an outer wall member having an inner enlargement on the outer end thereof, is constructed to resiliently engage an opposed inner wall member. The outer wall member could be somewhat longer than the inner wall member and the enlargement is tapered to facilitate assembly of the panel support unit to the projecting side edge portion of the back plate. The edge portion is formed with a struck out or lanced portion extending outwardly into engagement with the attachment leg or section of the panel support unit. The lanced portion is conveniently formed of a C-shaped configuration with a relatively sharp edge for embedment within the attachment leg. The struck out portion presents a sharp edge which is embedded into the enlargement and fixedly secures the panel support unit to the edge portion of the back plate, and thereby effectively permanently attaches the panel support unit to the back plate.

The inner and outer wall members of the attachment leg or section are formed such that the enlargement resiliently engages the inner surface of the inner wall. Thus, in the assembly, the tapered enlargement moves over the edge portion and the locking members to provide the fixed support to the back plate.

The panel support section or leg of the panel support unit is similarly formed by a pair of spaced walls. The walls, however, are spaced from each other forming an open slot for receiving of the two panels and the interposed display material. Of the two walls, the inner wall extends somewhat beyond the outer wall to provide for more convenient insertion of the superimposed panels and display material. Thus, the extended wall forms a convenient support against which the panel and display assembly can be placed for alignment with the slot.

In a preferred construction, the box unit further includes a shaped bottom and top walls to present initial light emissions. The top and bottom walls and the front panel support may also be advantageously formed to allow a small forward light emission which with optical clear support units present the display material within an encirclement of emitted light.

The inventor has discovered the substantially U-shaped panel support units with the dual slotted section which are connected by the curved base, provides for a modular construction for interconnection to the back plates of different sizes and dimensions produces a particularly satisfactory and esthetically pleasing presentation of the display material, and with a structure which is highly cost effective in fabrication, use and maintenance.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 1 is a front elevational view of a display box constructed in accordance with the teaching of the present invention and with parts broken away to show detail;

FIG. 2 is a top view of the display box shown in FIG. 1;

FIG. 3 is an enlarged fragmentary, horizontal, sectional view of a panel support unit shown in FIGS. 1–2, and taken generally on line 3—3 of FIG. 1;

FIG. 6 is an end view of a three sided handing display or sign unit constructed in accordance with the teaching of the present invention;

FIG. 7 is a side view of FIG. 6;

DESCRIPTION OF THE ILLUSTRATED EMBODIMENT

Figure 4:
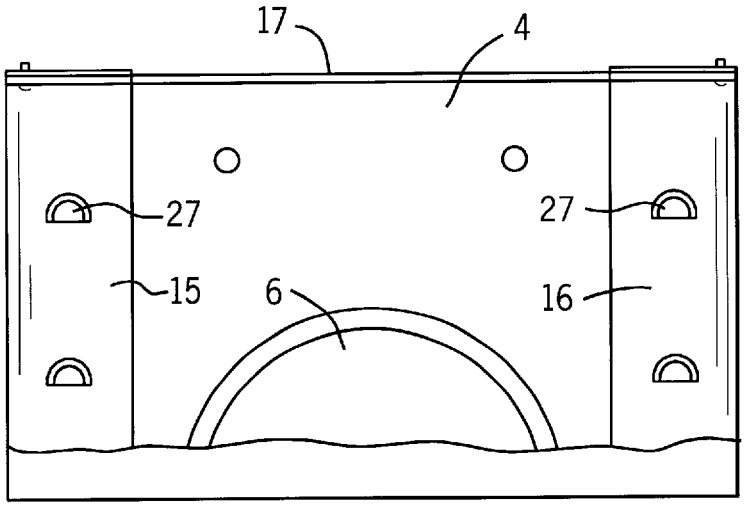
FIG. 4 is a fragmentary, elevational view of the back plate of the display box shown in FIGS. 1–3.

Referring to the drawings, and particularly to FIGS. 1 and 2, a display sign unit or box 1 is illustrated which is adapted to be mounted to a support wall 2 or other supporting structure and surface. The box includes a housing 3 having a back wall 4 and a front curved wall 5, which extends from one side to the opposite side of the housing and back wall 4. Lighting units 6 are shown secured to the central portion of the back wall 4 to illuminate the curved front wall 5. The curved front wall 5 is formed as a dual panel unit of light transparent material, and preferably an optically clear plastic material. Display material 7, preferably in the form of a poster of the like, is releasably held in place within the dual panel unit 5, with the lighting providing back illumination and projection of the display material in an aesthetic pleasing presentation.

In accordance with known systems, the dual panel unit of wall 5 includes essentially identical inner and outer shaped rectangular panels 8 and 9 of a transparent plastic or the like having a degree of flexibility. The superimposed panels are adapted to support a display material such as a poster 10 held therebetween.

The present invention is particularly directed to provide a special sidewall member defining the dual panel support units 11 and 12 to the opposite sides of the housing 3 and specially constructed for the direct and releasable placement of the dual panel unit 5 in place, to define the curved front wall 5. Each panel support unit 11 and 12 is essentially identically constructed for fixed interconnection to the back wall 4 and the releasable interconnection of the curved panel unit 5. The separate essentially identical panel support unit 11 and 12 particularly adapt the structure to production of different sized boxes with convenient and cost effective method of attaching the appropriate dual panel units in place.

More particularly, as shown in FIGS. 1, 2 and 4, the back wall 4 includes a flat back plate 13 having suitable mounting means, such as opening means 14 for securing of the display box 1 to the wall 2 or other suitable support through the use of clamping bolts, screws or other interconnecting projections.

The lighting units 6 are diagrammatically shown as round fluorescent units secured to the central portion of the back plate for illuminating of the curved panel unit 5. The back plate 13 includes forwardly angled side edge portions 15 and 16 with the panel support units 11 and 12 secured to the outer ends of the side edge portions. Thus, the side edge portions 15 and 16 are shown as essentially similar, angularly outwardly bent extensions of the back plate 1.3 at an appropriate desired angle, with respect to the back plate. In actual practice, a 45° angle has been used.

The unique sidewall members or panel support units 11 and 12 are specially constructed for telescoping over the outer ends of side edge portions 15 and 16 to receive and hold the dual panel unit 5 in the curved state.

The top and bottom openings defined between the back plate 13 and the front wall defined by the dual panel unit 5 are preferably closed by top and bottom walls; preferably formed by outwardly bent top and bottom edge portion 17 and 18 of the back plate 13, as shown in FIGS. 1 and 2.

Each of the panel support units 11 and 12 is constructed and preferably formed as an extruded plastic member of a substantial length, which can then be separated to form sidewall lengths of corresponding to the vertical length of a back plate and box.

Referring particularly to FIGS. 3 and 4, the panel support unit 11 is described. The corresponding elements of the panel support unit 12 are identified by corresponding primed numbers for simplicity of description.

Generally, the panel support unit 11, as shown most clearly in FIG. 3, is a substantially U-shaped integral member having a curved base 20 with slotted sections or legs 21 and 22 extending linearly therefrom. The slotted leg 21 defines an attachment unit which telescopes over the outer end of bent edge portion 15 of the back plate 13 and which fixedly secures the support unit to the back plate 13. The oppositely located and second slotted leg 22 projects from the curved base 20 and extends laterally over the back edge portion and outwardly therefrom to present an angled slot within which the side edges of the dual panel unit 5 is inserted. The dual panel unit 5 has a width in excess of the width between the panel support units, and because of the panel flexibility, the insertion into the slotted legs 22 and 22' not only support and retain the panels, but shapes the panel unit into a curved front wall.

More particularly, the slotted legs 21 and 22 are connected to the base 20, which is a single thickness wall, and which curves to extend the slotted legs 21 and 22 in spaced relation through an appropriate angle, which in one design was 45°.

The attachment slotted leg 21 includes a back wall 23 and a front wall 24 extending substantially parallel to each other, and defining a planar opening or slot 25 therebetween. The back wall 23 is slightly longer than the front wall 24. In addition, the inner surface of back wall 23 at the outer end thereof is formed with an enlarged inclined camming surface or member 26. The cam member 26 extends from the outer edge of the wall inwardly and laterally, terminating within the outer end of the front wall 24. The front wall 24 of the slotted leg 21 is generally spaced by a distance less than the thickness of the side edge portion 15, and may have a slight inward inclination, such that the end of cam 26 engages the front wall 24. The legs are somewhat flexible and allow the ready introduction of the slotted leg over the edge portion 15 of the back plate 14. A stabilizing rib 26a is formed on the inner surface of wall 23 and provides a snug support on the metal edge portion.

In the illustrated embodiment of the invention as shown in FIGS. 1, 3 and 4, a plurality of longitudinally spaced struck out portions 27 are formed in the side edge portion 15 which are overlapped by the slotted leg 21 and particularly back wall 23. The struck out portions 27 are projected outwardly and move into engagement with the inner surface of the outer back wall 23, shown as the cam members 26. The struck out portion is shown as C-shaped members, with the curved edge facing the leg surface for embedment in the member to fixedly secure the panel support unit 11 to the back plate 13 and locating the front slotted leg 22 projecting outwardly and inwardly over lying the side edge portion of the back plate.

Slotted leg 22 includes an outer or front wall 28 formed as a continuous extension of the U-shaped base 20, and extends generally outwardly to the same length of the walls of the slotted leg 21. An L-shaped inner leg 29 is secured to the front wall 28, at approximately the center thereof. The inner wall of leg 29 extends outwardly beyond the front wall 28 by a short distance to form a lip 29*a*. The walls of leg 22 are formed substantially parallel and spaced from each other and define an open slot 30 therebetween.

The two superimposed panels 8 and 9, with or without the display poster 10, are readily and freely inserted and removed from the slot 30. The lip 29*a* provides a support surface against which the panel unit 5 may be placed to facilitate the insertion of panel unit 5 into the support units. When inserted, the panel unit 5 defines a curved wall configuration held in place under the flexed forces in the panel unit 5 to firmly and reliably hold the assembly in place.

The panels 8 and 9 and the panel support units 11 and 12, are preferably formed of an optically clear plastic such as PETG, which also has a sufficient degree of flexibility to permit the insertion and removal while maintaining a firm, front wall structure.

Panel support units 11 and 12 are readily formed as elongated extruded members, which are then cut to the desired length corresponding to the depth of the display box, and particularly the front wall structure. Such modular edge construction adapts the display box fabrication to different sizes and lengths. The slot 30 can, of course, be readily constructed to adapt the different boxes to panel members of slightly different thickness, while also permitting the use of a display posters of different thicknesses and the like.

Figure 5:
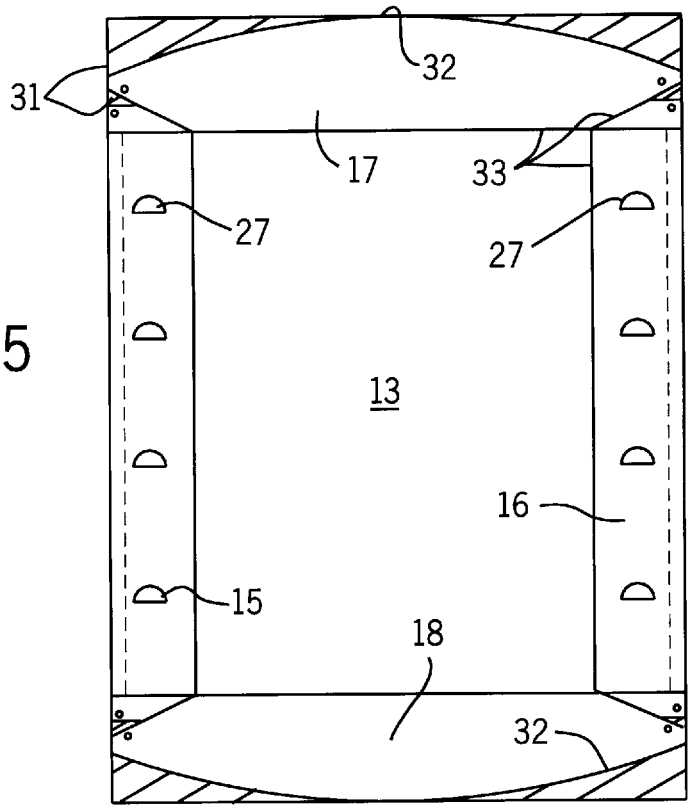
FIG. 5 is a plan view of a source plate for forming of the back plate shown in FIG. 4.

The back plate is preferably formed from a flat metal sheet 31, such as shown in FIG. 5. The flat metal sheet is provided with appropriate top and side notches and removed portions 31 between the top and bottom portions to define the side edge portions 15 and 16 and the top and bottom wall portions 17 and 18 of the box. The bend lines are shown in solid lines 33. The top and bottom edges are further curved, as at 32, to correspond to the curvature of the curved front wall unit 5. The edges of the sheet 31 are bent outwardly to form the back plate 13 with the integrated angled side edge portions 15 and 16, as well as the flat top and bottom portion 17 and 18. The edge portion 15 and 16 include the C-shaped struck out portions 27. The top and side edge portion, as well as the bottom and side edge portion, can be shaped to provide slight overlap at the joining portions and interconnected to each other to provide a rigid box structure. This provides for a convenient low cost fabrication of the back plate 13, as well as providing the desired rigidity in the box structure.

Figure 8:
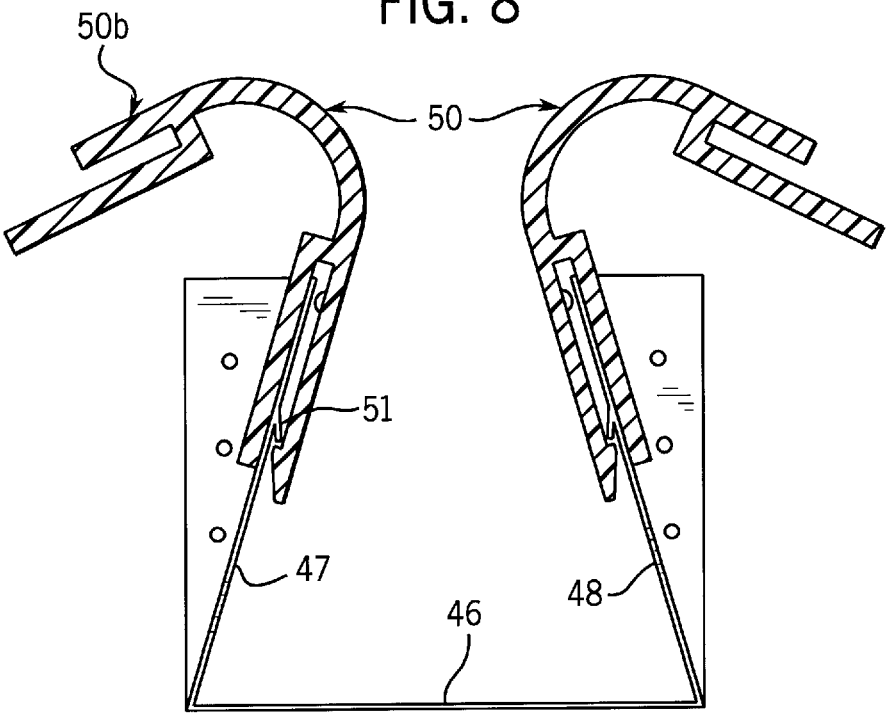
FIG. 8 is an enlarged, horizontal sectional view taken generally on line 8—8 of FIG. 7 and illustrating the detail of the illustrated embodiment.

A second embodiment is disclosed in FIGS. 6–8 for purposes of disclosing one variation which may be constructed within the teaching of this invention. The second embodiment may be a hanging display or supported on the underside, with or without rotation for appropriate display of the several signs.

Referring particularly to FIGS. 6–8, an illuminated multi-sided display sign unit 36 is disclosed including three display signs 37, 38 and 39 in a equi-triangular orientation. Each sign 37, 38 and 39 is preferably constructed, as such, as illustrated in the embodiment of FIG. 1, with display material interposed between two clear plastic members to form a panel unit.

More particularly, the illustrated embodiment includes an upper wall plate 40 and a bottom wall plate 41 which are spaced from each other by spaced dual panel support units 42, 43, and 44. Each unit is similarly constructed, and referring to unit 43, supports the adjacent edges of the adjacent sides of the two signs, as shown in the cross sectional view (FIG. 8) taken generally on line 8—8 of FIG. 7. The panel support unit 43 includes a separate bracket 45 which is fixed in position between the two plates 40 and 41. The bracket 45 is a substantially rectangular U-shaped member having an interface wall or base 46 and the sidewalls 47 ahd 48 projecting outwardly of the display unit. The opposite ends of the sidewalls are provided with similar right angle mounting flanges 49 which are riveted or otherwise firmly fastened to the respective top plate and bottom plate. The bracket 45 terminates within the outer peripheral edge of the top and bottom plates 40 and 41, and each is located with the sidewalls 47 and 48 forming attachment flanges to receive and support a framemember for the associated side and sign of the display unit. Each sidewall 47 and 48 is a flat, rigid flange to receive the attachment leg 50*a* of a frame or panel support 50 as in the first embodiment, and shown in FIG. 8, in which only supports 50 are shown. The sidewall flanges 47 and 48 have struck out portion 51. The sidewalls are particularly located to locate the slotted leg 50*b* of the support 50 for receiving the sign extended outwardly, generally in a plane at 60° with respect to the corresponding slotted leg of the adjacent panel support unit.

Each dual support unit 42, 43 and 44 has bracket legs which generally extend across the corresponding adjacent side of the equi-triangular display sign unit. The spacing between the spaced support sidewalls receive the sign with a bowed presentation as a result of the resiliency of plastic panels in the slotted legs as in the prior embodiment, in which the flange on the back wall formed an integral single wall bracket.

In the embodiment of FIGS. 6–8, a lamp support structure 52 is secured to the interior of the top plate 40. A plurality of lamps 52*a* are secured in place, preferably with a lamp generally centrally aligned with each sign of the display sign unit. An electrical cable assembly 53 projects outwardly through an appropriate opening in either end wall formed by the bottom and upper plates 40 and 41, which may include a suitable hanging support structure, not shown. The display sign unit may also be readily placed upon a raised support structure to locate the signs in a particular location with access to the three sides for viewing.

In the illustrated embodiment, the top and bottom plates have the three sides formed with a curvature generally corresponding to the curvature of the panel units in the assembled position. The curvature preferably provides a slight extension of the top and bottom plates beyond the panel units in a preferred construction. In addition, an inherent slight, light transmitting gap appears at the top and bottom edges of the panel units such that the total assembly provides an essentially light halo about each display sign. The combination of the gentle curvature of the top and bottom plate in combination with the curved wall structure produces a very aesthetically pleasing and attractive display sign.

As described in the first embodiment, the panel supports may be formed of a clear plastic material. A construction using a corresponding colored plates, supports, brackets and panels, rather than clear, light transmitting supports has also been produced which presented a highly aesthetically pleasing presentation of the individual display units.

Figure 10:
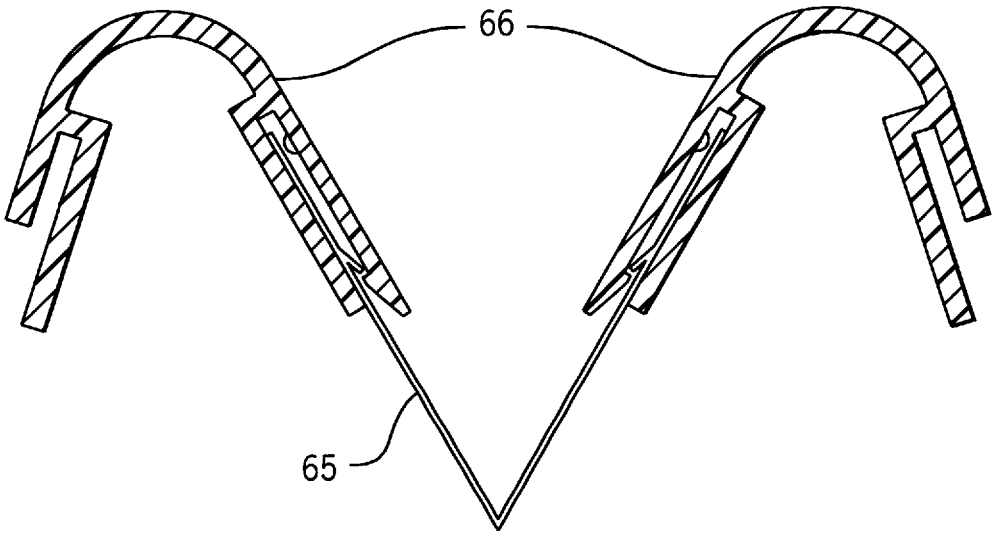
FIG. 10 is a view similar to FIG. 8, taken on line 10—10 of FIG. 9.
Figure 9:
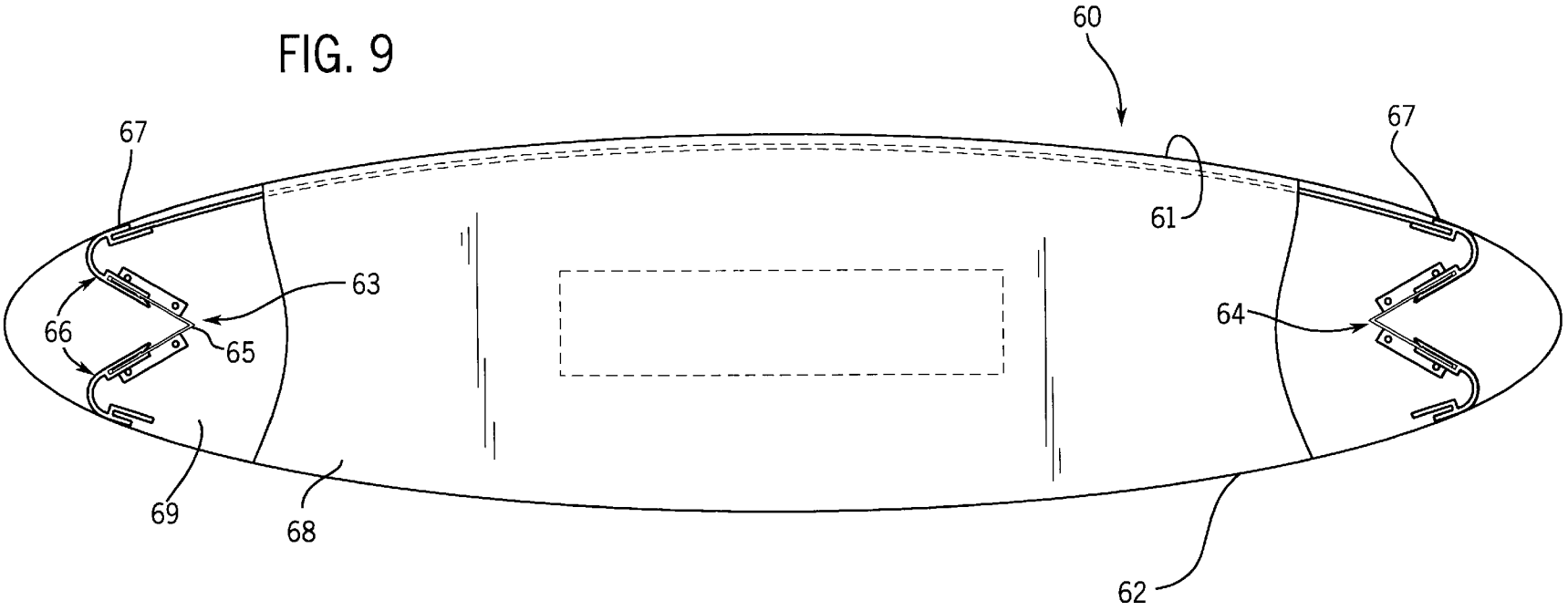
FIG. 9 is a view similar to FIG. 6 illustrating the fragmentary portion of a two sided display or sign unit.

A further variation of a display sign apparatus or unit is shown in FIGS. 9 and 10, and particularly a two-sided sign structure 60 produces a pair of back-to-back signs 61 and 62. In this embodiment, a pair of generally U-shaped support units 63 and 64 each includes a generally U-shaped bracket 65 having a more pronounced V-configuration on the opposite sides of the sign structure. This locates the brackets 65 spaced across from each other at the opposite sides of the display unit. The standard U-shaped frame units 66 are secured and fixed to the bracket sidewall. The panel support arms 67 are located in spaced, aligned location to produce a bold presentation and support of the display panel units to one side of the sign structure. Again, the top and bottom wall plates 68 and 69 are preferably provided with the appropriate curved configuration to blend with the curved signs, and again produce a highly effective visual presentation.

Other multi-sided arrangements can, of course, be provided by the very simple procedure of providing an appropriate bracket arrangement with the sidewalls appropriately spaced to locate the opposite sides of the panel supports in appropriate location with the fixed support arms and the slotted panel arms properly aligned.

The U-shaped brackets may be formed of separate sidewalls which are secured and placed with the proper angular locations for the particular offset of the display signs within an illuminated enclosure.

Thus, the present invention with the simple shaped support structure in combination with a substantially standard panel support unit permits wide variation in the construction of various sizes and shapes of display sign units. The support structure with the brackets to support the molded panel support units provide cost effective components for fabrication of the various display sign units in accordance with the personal preferences and demands of a purchaser and/or user.

Although described with the panel support units of essentially identical construction, and with the particular fixed leg structure secured to the back plate, variations in the construction of such elements can be readily provided by those skilled in the art, while maintaining the panel support structure with the simple slot support structure of the dual panel units. Similarly, although a optically clear plastic is desired for the panel support unit and the front wall panels, other materials including suitably clear, partially clear, or colored plastic or the like may be used to vary the presentation. Although the panel support members are of distinct U-shaped configuration, some variation therein can be permitted without loss of the apparent frontless display box appearance.

Various modes of carrying out the invention are contemplated as being within the scope of the following claims particularly pointing out and distinctly claiming the subject matter which is regarded as the invention.

I claim:

1. An illuminated display apparatus for displaying of illuminated material as a front wall comprising:

a front panel unit including inner and outer superimposed panels having substantially the same width and aligned first and second side edges, each of said panels being formed of a light transmitting material and adapted to support display material, a support structure including spaced first and second vertical wall members with the spacing being less than the width of a panel unit, a first and a second panel support member secured to the spaced first and second wall members, each said panel support member being a substantially U-shaped member including a first section and a second section joined by a substantially curved base portion, said first section including a pair of spaced walls for attachment engagement with said first spaced vertical wall member, said second section connected to said first section by said curved base portion and locating the second section in predetermined location for receiving of the side edges of the panel unit, said second section including spaced walls defining an open slot for releasably inserting of the corresponding side edges of the panel unit and thereby permitting attachment and detachment of the panel unit directly to and from the second sections of said first and second panel support members.

2. The display apparatus of claim 1 wherein the support structures includes second vertical wall members secured to said first vertical wall members and angularly oriented with respect thereto, and including third and fourth panel support units connected one to each of said second vertical wall members, each of said second support units being substantially U-shaped member including a first section having spaced walls located in clamping engagement to outer portions of the second vertical wall and a second section including a slot opening and extending outwardly and toward the opposite support sidewall at a selected angle and a second panel display unit having side edges in said slot openings of said second vertical wall members.

3. An illuminated display box for displaying of illuminated material as a front wall comprising:

a support enclosure having spaced edge portion, a front panel unit including inner and outer superimposed panels having substantially aligned side edges, each of said panels being formed of a light transmitting material and adapted to support display material, a first and a second panel support member secured to said spaced edge portions, each said panel support member being a substantially U-shaped member including a first section and a second section joined by a substantially curved base portion, said first section including a pair of spaced walls for attachment engagement with said first spaced edge portion, said second section connected to said first section by said curved base portion and locating the second section in predetermined location for receiving of the side edge of the panel unit, said second section including spaced walls defining an open slot for releasably inserting of the corresponding side edge of the panel unit and thereby permitting attachment and detachment of the panel unit directly to and from the second sections of said first and second panel support members.

4. The display apparatus of claim 3 wherein the panel unit is dimensioned in relation to the said panel support members to locate and hold said panel unit as a curved configuration when fitted within the panel support members.

5. The display apparatus of claim 3 wherein said panels are flat plate-like flexible members and are bent into a substantial curved configuration upon entry into the panel support members and are held in an outwardly curved configuration.

6. A display apparatus for displaying information, comprising: an opened box-like support structure having an open front wall defined by spaced support sidewalls and top and bottom walls, said sidewalls and said top and bottom walls being interconnected, first and second panel support units connected one to each of said support sidewalls, each of said support units being an integrally formed and substantially U-shaped member including a first section having spaced walls located in clamping engagement to outer portions of the support sidewall and a second section including slot opening and extending outwardly and toward the opposite support sidewall at a selected angle, a panel display unit including superimposed transparent panels adapted to receive a display member interposed therebetween, said panels being formed of a flexible plastic and having a width in excess of the distance between said slots of said panel support units whereby insertion of the panel edges of the panels into the slots results in a curved front wall extending between said support units, and said U-shaped members and said panels being formed of a substantially optically clear plastic.

7. The display apparatus of claim 6 wherein said top and bottom walls extend outwardly over the opposite ends of the panel support units and close the slots to removably retain the panels in place.

8. The display apparatus of claim 6 wherein each of said panel support unit is a single integrally extruded plastic member of an identical construction.

9. The display apparatus of claim 8 wherein said plastic member is a PETG plastic.

10. The display apparatus of claim 6 wherein each said panel support unit includes a U-shaped curved base connecting said first and second sections, said first section including an outer wall extending as a substantially in-line extension of the curved base wall and terminating at the outer end in a laterally inwardly extended cam surface and including an inner wall spaced inwardly of the outer wall and with the outer end of the inner wall engaging said cam surface to establish a clamping force on the support sidewall.

11. The display apparatus of claim 10 wherein said sidewalls of said box-like structure includes sharp embedment elements embedded in said first section of the panel support unit to fully secure the panel support units to said boxlike structure.

12. The display apparatus of claim 10 wherein said second section includes an inner wall extending as a substantially in-line extension of said curved base wall and an outer wall spaced inwardly from said inner wall and forming said slot.

13. The display apparatus of claim 12 wherein said inner wall of said second section is a substantially L-shaped wall having a base secured to said outer wall and a leg extending from the base parallel to said outer wall and outwardly of said outer wall to provide a support lip for insertion of the panel unit.

14. The display apparatus of claim 6 wherein said inner wall of said second section is an L-shaped wall having a base secured to said outer wall and a leg extending from the base parallel to said outer wall.

* * * * *